United States Patent [19]

Chillino

[11] 4,048,678

[45] Sept. 20, 1977

[54] INFLATABLE COVER FOR A SWIMMING POOL

[76] Inventor: Joseph Chillino, 15 Clark Road, Stoney Point, N.Y. 10980

[21] Appl. No.: 629,084

[22] Filed: Nov. 5, 1975

[51] Int. Cl.[2] ..... E04H 3/16; E04H 3/18; F16L 22/02

[52] U.S. Cl. ..... 4/172.12

[58] Field of Search ..... 4/172, 172.12, 172.11, 4/172.13, 172.14

[56] References Cited

U.S. PATENT DOCUMENTS

| | | | |
|---|---|---|---|
| 3,077,610 | 2/1963 | Gazdik | 4/172.12 |
| 3,509,585 | 5/1970 | Solomon | 4/172.12 |
| 3,512,186 | 5/1970 | Sanford | 4/172.12 |
| 3,523,308 | 8/1970 | Bradley | 4/172.12 |
| 3,676,880 | 7/1972 | Kwake | 4/172.12 |
| 3,683,427 | 8/1972 | Burkholz et al. | 4/172.12 |
| 3,732,581 | 5/1973 | Pitti et al. | 4/172.12 |
| 3,810,262 | 5/1974 | Strand | 4/172.12 |

*Primary Examiner*—Henry K. Artis
*Attorney, Agent, or Firm*—Allison C. Collard

[57] ABSTRACT

A pool cover made of vinyl or other suitable solid material extends dome-like over the entire pool and has a skirt welded to the inner surface of the cover and engaging all inner surfaces of the walls of the pool. The skirt is adapted to extend below the water line and up to the edges of the pool walls. The cover has end portions extending over the wall edges upon the deck and adapted to receive water bags or the like which hold the cover in place.

1 Claim, 2 Drawing Figures

INFLATABLE COVER FOR A SWIMMING POOL

This invention relates to a cover for a swimming pool.

There are in existance several types of pool covers. The most popular one is apparently a cover made of vinyle sheet material which is laid on the water surface. It is held in place on pool deck by water bags. There is also a tiedown cover consisting of a vinyl sheet with grommets around its perimeter through which a rope is tied. The rope is secured to stakes in order to keep the cover in place.

A cover of this type lies upon the water surface which is below the deck level. Thus the cover has the shape of a saucer or dish. There is the drawback that water, snow, ice, along with dust, dirt, leaves and other debris fall or are blown upon the cover. This creates the problem of pumping water from the cover, removing the collected debris from the cover and then cleaning the cover itself. The weight accumulated upon the cover may cause the cover to drag into the pool or tear it out of the grommets with the result that the collected dirt and debris will fall into the pool water. There is also the danger that the pool water may overflow due to the rain, snow and ice build up on top of the cover.

Another existing pool cover is of the mesh type and is made of woven plastic ribbon or thread forming a sheet of screen-like material. While this cover is lighter and easier to handle than a vinyl cover, it has the drawback that dust and dirt will penetrate through it. Sun light will also penetrate inducing the growth of bacteria in the water of the pool.

There is also a pool cover which is dome-shaped. It is inflated by a squirrel cage type blower and is held down by the use of water bags. This type is more useful as an enclosure than as a cover. The cover has a zippered opening for entrance and exit. Due to the provision of this opening and to leakage from water bags, the blower working on a pressure switch, must be practically constantly operated. In winter months the dome must be deflated, so that it will lie as a cover upon the water. A substantial drawback is the bulk of this type of cover.

An object of the present invention is to improve pool covers of the described types.

Another object is the provision of a swimming pool cover which will effectively keep dust, dirt, and debris from falling or blowing into the pool water and which can be used as a safety cover.

Other objects of the present invention will become apparent in the course of the following specification.

In the accomplishment of the objectives of the present invention it was found desirable to provide a pool cover made of vinyl or other suitable solid material which extends dome-like over the entire pool and has a skirt welded to the inner surface of the cover and engaging inner surfaces of all the walls of the pool. The skirt is adapted to extend below the water line and up to the upper edges of the pool walls. The cover has end portions extending over the wall edges upon the deck and adapted to be engaged by water bags or the like which hold the cover in place. A fill hole with a check valve is provided close to the bottom portion of the cover for the supply of air.

The invention will appear more clearly from the following detailed description when taken in connection with the accompanying drawing showing by way of example only, a preferred embodiment of the inventive idea.

Figure 1:
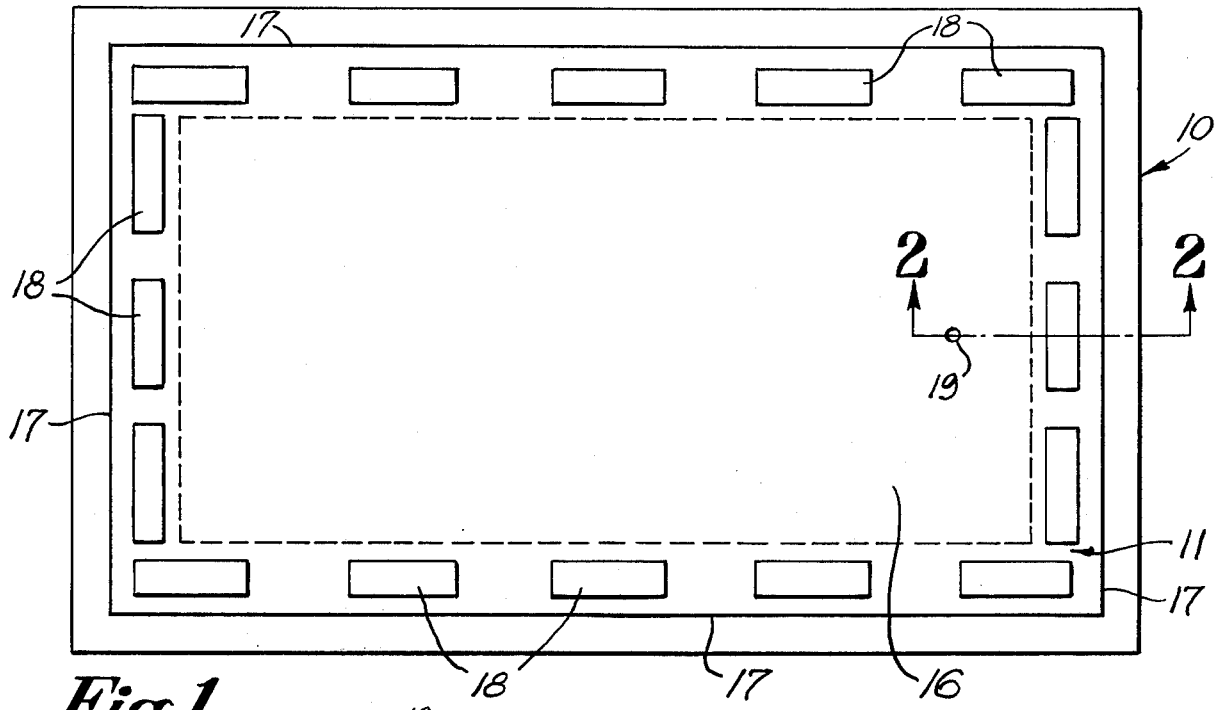
FIG. 1 is a top view illustrating a pool cover of the present invention.
Figure 2:
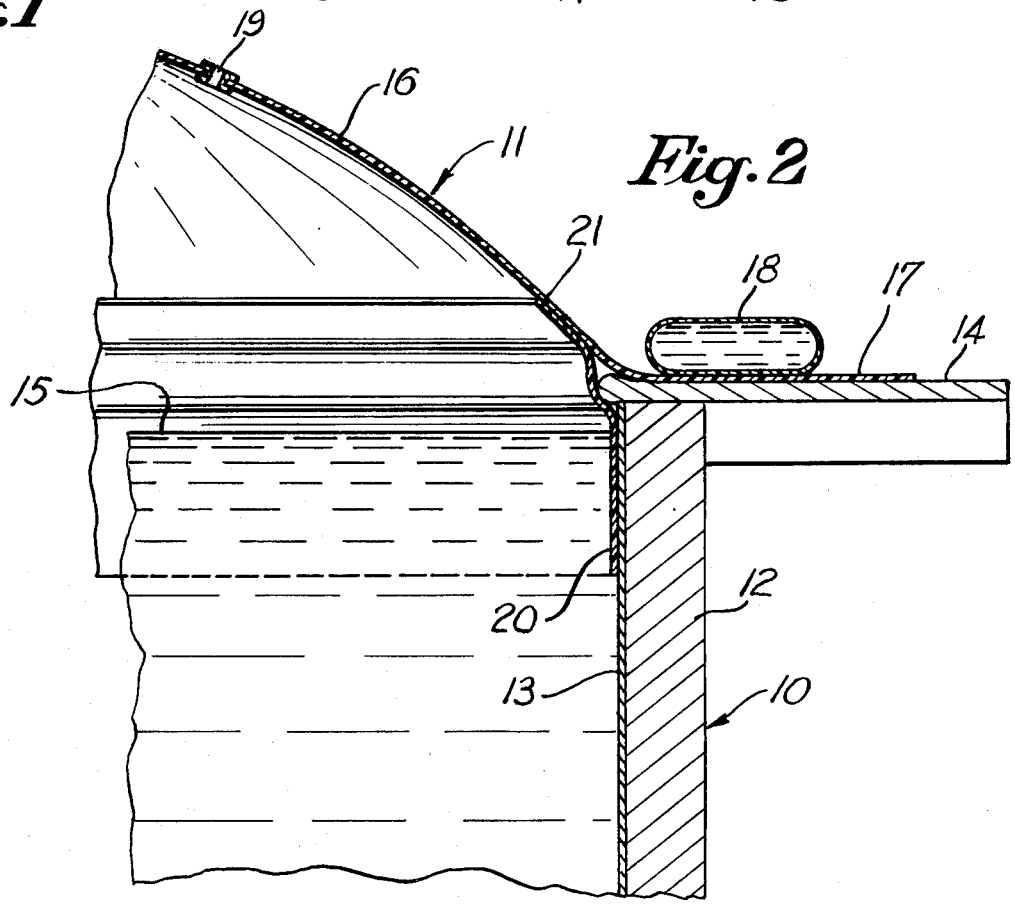
FIG. 2 is a partial transverse section along the line II—II of FIG. 1.

The drawing shows a pool 10 and a cover 11. The pool 10 is enclosed by walls 12 having inner surfaces 13 and an upper deck 14. The water level is indicated by the numeral 15. The cover 11 is made of vinyl or any other suitable solid material. It has an upwardly extending dome 16 and side sheets 17 enclosing the dome and carried upon the deck 14. Water bags 18 are placed upon the sheets 16 to hold the cover in place. The dome is provided with a fill hole 19 with check valve (not shown) for supplying air.

In accordance with the present invention the cover 11 is provided with an inner skirt 20. The skirt 20 extends all around the dome and is welded to inner surfaces of the dome at 21 close to the location where the side sheets 17 extend away from the dome. Thus the skirt 20 will lie against the inner surfaces 13 of the pool walls. The skirt 20 is of adequate length, so that it will extend below the water level 15.

Since the skirt 20 is welded to the main body 16 of the cover and it falls into the pool water, a positive seal is created and there is no loss of air pressure. Thus the cover needs to be filled only once to maintain its shape, using a common house vacuum cleaner pumping through the fill hole 19. Due to the positive seal there is no evaporation or loss of pool water, while the dome 16 prevent overflow of pool water by causing rain water to run off. Thus the user can keep the pool water at a more desirable high level.

Another advantage of the desired cover is that it is relatively easy to install and to remove. In the drawing it is shown as being held by water bags 18. However, other holding means can be used, such as grommets or a rope welded to the cover at certain intervals. It is merely necessary to hold down the cover so that it will not float away.

Due to the positive seal of the cover less winterizing chemicals are required for the water.

Since the cover is inflated and there is air space between the cover and the pool water, the temperature of the pool water can be kept quite high, particularly in the months prior to removing the cover in late spring. The cover actually acts as a "hot house" for the swimming pool. Thus fuel is preserved and the pool owner is spared the substantial costs of bringing the water temperature up to the desired level.

Another advantage is that due to the domed shape no dirt or debris can accumulate in the domed surface, so that the cover requires no cleaning when removed for storage.

Since the cover will keep the pool water at a substantially high temperature the pool could be used not only for swimming, but for a variety of other uses, such as a reservoir for the storage of heat generated by one of the heating plants. Pool water could be also pumped into the heating lines of a house for use in its heating system. Fuel conservation and savings would be considerable.

I claim:

1. A device for use in a swimming pool having interconnected side walls enclosing a closed area, said pool containing water to a depth to substantially cover the side walls and a deck extending above the side walls and connected with the top rim of all the side walls, comprising a pool cover having a curved dome extending above the entire area of the pool, side sheets integral with said dome and extending around the entire area of the pool, said side sheets being located upon said deck, means holding said side sheets upon said deck, and an inner skirt connected with the inner surfaces of said dome adjacent the pool edge and extending around the entire rim area of the pool, said skirt depending from said side sheets and engaging the inner surfaces of all said side walls along the outer surfaces of the skirt and extending substantially into the water depth of the pool.

* * * * *